US008662040B2

(12) United States Patent
Knecht et al.

(10) Patent No.: US 8,662,040 B2
(45) Date of Patent: Mar. 4, 2014

(54) OSCILLATING-MOTOR CAMSHAFT ADJUSTER HAVING A HYDRAULIC VALVE

(75) Inventors: Andreas Knecht, Kusterdingen (DE); Dirk Pohl, Kirchentellinsfurt (DE)

(73) Assignee: Hilite Germany GmbH, Marktheidenfeld (DE)

( * ) Notice: Subject to any disclaimer, the term of this patent is extended or adjusted under 35 U.S.C. 154(b) by 437 days.

(21) Appl. No.: 13/074,373

(22) Filed: Mar. 29, 2011

(65) Prior Publication Data

US 2011/0247576 A1 Oct. 13, 2011

(30) Foreign Application Priority Data

Apr. 10, 2010 (DE) ..... 10 2010 014 500
Sep. 14, 2010 (DE) ..... 10 2010 045 358

(51) Int. Cl.
*F01L 1/34* (2006.01)

(52) U.S. Cl.
USPC ..... 123/90.17; 123/90.15

(58) Field of Classification Search
USPC ..... 123/90.15, 90.17; 137/625.65
See application file for complete search history.

(56) References Cited

U.S. PATENT DOCUMENTS

| | | | |
|---|---|---|---|
| 699,273 | A | 5/1902 | Wolski |
| 894,286 | A | 7/1908 | Reineking |
| 1,746,855 | A | 2/1930 | French |
| 1,860,163 | A | 5/1932 | Wyzenbeek |
| 2,649,105 | A | 8/1953 | Stout et al. |
| 2,781,059 | A | 2/1957 | Frey |
| 2,918,941 | A | 12/1959 | Whiting |
| 3,779,669 | A | 12/1973 | Sommer |
| 3,783,590 | A | 1/1974 | Allen |
| 3,882,891 | A | 5/1975 | Viles et al. |
| 4,051,864 | A | 10/1977 | Iwatsuki |
| 4,241,758 | A | 12/1980 | Eiermann |
| 4,274,385 | A | 6/1981 | Yuzawa et al. |

(Continued)

FOREIGN PATENT DOCUMENTS

| | | |
|---|---|---|
| DE | 2 025 168 | 12/1971 |
| DE | 2 043 002 | 3/1972 |

(Continued)

OTHER PUBLICATIONS

Smith et al., "A Camshaft Torque-Actuated Vane-Style VCT Phaser", pp. 43-50 (SAE International, Jan. 2005).

(Continued)

*Primary Examiner* — Thomas Denion
*Assistant Examiner* — Jorge Leon, Jr.
(74) *Attorney, Agent, or Firm* — Lipsitz & McAllister, LLC

(57) ABSTRACT

The invention relates to an oscillating-motor camshaft adjuster having a hydraulic valve, which has two working ports. These two working ports each have a standard opening axially adjacent to one another and an opening for the utilization of pressure peaks as a consequence of camshaft alternating torques. A hydraulic pressure can be guided from a supply port to the working port to be loaded, while the working port to be relieved of pressure is guided to a tank port. In order to also keep the control performance high in the case of internal combustion engines with very greatly fluctuating camshaft alternating torques, it is proposed according to the invention that a position of hydraulic valve can be controlled proportionally, in which the pressure peaks of the working port to be relieved of pressure are blocked relative to the supply port and the working port that is to be loaded.

6 Claims, 4 Drawing Sheets

(56) References Cited

U.S. PATENT DOCUMENTS

| | | | |
|---|---|---|---|
| 4,787,345 | A | 11/1988 | Thoma |
| 4,854,649 | A | 8/1989 | Arikawa |
| 5,138,985 | A | 8/1992 | Szodfridt et al. |
| 5,323,806 | A | 6/1994 | Watari et al. |
| 5,645,017 | A | 7/1997 | Melchior |
| 5,657,725 | A | 8/1997 | Butterfield et al. |
| 6,024,061 | A | 2/2000 | Adachi et al. |
| 6,035,819 | A | 3/2000 | Nakayoshi et al. |
| 6,053,139 | A | 4/2000 | Eguchi et al. |
| 6,058,897 | A | 5/2000 | Nakayoshi |
| 6,085,708 | A | 7/2000 | Trzmiel et al. |
| 6,209,497 | B1 | 4/2001 | Niethammer et al. |
| 6,234,125 | B1 | 5/2001 | Neubauer et al. |
| 6,267,041 | B1 | 7/2001 | Skiba et al. |
| 6,408,807 | B1 | 6/2002 | Komazawa et al. |
| 6,453,859 | B1 | 9/2002 | Smith et al. |
| 6,532,921 | B2 | 3/2003 | Sato et al. |
| 6,739,297 | B2 | 5/2004 | Palesch et al. |
| 6,763,791 | B2 | 7/2004 | Gardner et al. |
| 6,782,856 | B2 | 8/2004 | Aimone |
| 6,814,036 | B2 | 11/2004 | Palesch et al. |
| 6,820,578 | B2 | 11/2004 | Kanada et al. |
| 6,845,740 | B2 | 1/2005 | Kohrs |
| 6,871,621 | B2 | 3/2005 | Palesch et al. |
| 6,883,481 | B2 | 4/2005 | Gardner et al. |
| 6,899,126 | B2 | 5/2005 | Weigand et al. |
| 6,941,912 | B2 | 9/2005 | Palesch et al. |
| 6,968,815 | B2 | 11/2005 | Palesch et al. |
| 7,011,059 | B2 | 3/2006 | Plank et al. |
| 7,025,023 | B2 | 4/2006 | Lehmann et al. |
| 7,121,553 | B2 | 10/2006 | Cornea et al. |
| 7,124,722 | B2 | 10/2006 | Smith |
| 7,198,013 | B2 | 4/2007 | Palesch et al. |
| 7,219,636 | B2 | 5/2007 | Sawada |
| 7,240,768 | B2 | 7/2007 | Sageman |
| 7,314,031 | B2 | 1/2008 | Le Troadec et al. |
| 7,331,318 | B2 | 2/2008 | Schweizer |
| 7,387,097 | B2 | 6/2008 | Schmitt et al. |
| 7,444,971 | B2 | 11/2008 | Suga et al. |
| 7,513,230 | B2 | 4/2009 | Knecht et al. |
| 7,533,695 | B2 | 5/2009 | Strauss et al. |
| 7,584,728 | B2 | 9/2009 | Berndorfer |
| 7,600,531 | B2 | 10/2009 | Patze et al. |
| 7,681,542 | B2 | 3/2010 | Paul et al. |
| 7,836,857 | B2 | 11/2010 | Knecht et al. |
| 7,866,289 | B2 | 1/2011 | Grunow et al. |
| 7,946,266 | B2 | 5/2011 | Knecht et al. |
| 7,987,827 | B2 | 8/2011 | Fujiyoshi et al. |
| 8,225,818 | B1 | 7/2012 | Stephens et al. |
| 2002/0062803 | A1 | 5/2002 | Sato et al. |
| 2002/0088413 | A1 | 7/2002 | Smith et al. |
| 2002/0088417 | A1 | 7/2002 | Palesch et al. |
| 2003/0033999 | A1 | 2/2003 | Gardner et al. |
| 2003/0070713 | A1 | 4/2003 | Cornea et al. |
| 2003/0116110 | A1 | 6/2003 | Kohrs |
| 2003/0177991 | A1 | 9/2003 | Palesch et al. |
| 2003/0188705 | A1 | 10/2003 | Aimone |
| 2004/0112314 | A1 | 6/2004 | Kanada et al. |
| 2004/0211379 | A1 | 10/2004 | Palesch et al. |
| 2004/0226526 | A1 | 11/2004 | Palesch et al. |
| 2004/0244852 | A1 | 12/2004 | Cornea et al. |
| 2005/0022760 | A1 | 2/2005 | Panciroli |
| 2005/0051123 | A1 | 3/2005 | Haser et al. |
| 2005/0056245 | A1 | 3/2005 | Plank et al. |
| 2005/0072397 | A1 | 4/2005 | Sluka et al. |
| 2005/0241603 | A1 | 11/2005 | Palesch et al. |
| 2005/0252561 | A1 | 11/2005 | Strauss et al. |
| 2005/0257762 | A1 | 11/2005 | Sawada |
| 2006/0201463 | A1 | 9/2006 | Schweizer |
| 2006/0225791 | A1 | 10/2006 | Patze et al. |
| 2007/0074687 | A1 | 4/2007 | Bosl-Flierl et al. |
| 2007/0074692 | A1 | 4/2007 | Schafer et al. |
| 2007/0266971 | A1 | 11/2007 | Bosl-Flierl et al. |
| 2008/0115751 | A1 | 5/2008 | Knecht et al. |
| 2008/0149056 | A1 | 6/2008 | Grunow |
| 2008/0149057 | A1 | 6/2008 | Grunow et al. |
| 2008/0184950 | A1 | 8/2008 | Lawrence et al. |
| 2008/0264200 | A1 | 10/2008 | Hoppe et al. |
| 2008/0301938 | A1 | 12/2008 | Bonse et al. |
| 2009/0020178 | A1 | 1/2009 | Stallmann |
| 2009/0056656 | A1 | 3/2009 | Strauss |
| 2009/0057588 | A1 | 3/2009 | Reilly |
| 2009/0071140 | A1* | 3/2009 | Knecht et al. ..... 60/420 |
| 2009/0071426 | A1* | 3/2009 | Knecht et al. ..... 123/90.17 |
| 2009/0133652 | A1 | 5/2009 | Fujyoshi et al. |
| 2009/0159024 | A1 | 6/2009 | Paul et al. |
| 2009/0159829 | A1 | 6/2009 | Hoppe et al. |
| 2009/0223049 | A1 | 9/2009 | Binder et al. |
| 2009/0241878 | A1 | 10/2009 | Yamaguchi |
| 2009/0272349 | A1 | 11/2009 | Methley et al. |
| 2009/0293826 | A1 | 12/2009 | Lancefield et al. |
| 2010/0037841 | A1* | 2/2010 | Strauss et al. ..... 123/90.15 |
| 2010/0199936 | A1 | 8/2010 | Weiss et al. |
| 2010/0269772 | A1 | 10/2010 | Takemura et al. |
| 2010/0288215 | A1 | 11/2010 | Takemura et al. |
| 2010/0300388 | A1 | 12/2010 | Lang et al. |
| 2010/0326385 | A1* | 12/2010 | Busse ..... 123/90.17 |
| 2011/0094464 | A1 | 4/2011 | Eimert |
| 2011/0139100 | A1* | 6/2011 | Busse et al. ..... 123/90.15 |
| 2011/0162603 | A1 | 7/2011 | Busse |
| 2011/0174253 | A1 | 7/2011 | Hoppe et al. |
| 2011/0197835 | A1 | 8/2011 | Boegershausen |
| 2011/0239966 | A1 | 10/2011 | Strauss |
| 2012/0145100 | A1 | 6/2012 | Meinig et al. |

FOREIGN PATENT DOCUMENTS

| | | |
|---|---|---|
| DE | 36 01 643 | 7/1987 |
| DE | 38 29 698 | 3/1989 |
| DE | 42 10 580 | 10/1993 |
| DE | 42 35 929 | 4/1994 |
| DE | 44 22 742 | 1/1996 |
| DE | 195 25 837 | 1/1997 |
| DE | 199 14 156 | 10/1999 |
| DE | 199 18 910 | 11/1999 |
| DE | 198 23 619 | 12/1999 |
| DE | 198 44 669 | 3/2000 |
| DE | 198 47 705 | 4/2000 |
| DE | 198 53 670 | 5/2000 |
| DE | 199 52 275 | 5/2000 |
| DE | 100 50 225 | 4/2002 |
| DE | 101 58 530 | 8/2002 |
| DE | 101 61 698 | 6/2003 |
| DE | 101 61 701 | 6/2003 |
| DE | 102 05 415 | 8/2003 |
| DE | 102 11 467 | 9/2003 |
| DE | 102 28 354 | 1/2004 |
| DE | 103 44 816 | 5/2004 |
| DE | 103 30 449 | 2/2005 |
| DE | 103 34 690 | 3/2005 |
| DE | 103 44 916 | 4/2005 |
| DE | 60201949 | 4/2005 |
| DE | 103 46 448 | 6/2005 |
| DE | 10 2004 038 252 | 12/2005 |
| DE | 10 2005 023 056 | 12/2005 |
| DE | 10 2005 004 281 | 1/2006 |
| DE | 10 2004 035 077 | 2/2006 |
| DE | 10 2004 039 800 | 3/2006 |
| DE | 602 07 308 | 3/2006 |
| DE | 10 2005 013 085 | 6/2006 |
| DE | 10 2005 034 275 | 1/2007 |
| DE | 10 2005 034 276 | 1/2007 |
| DE | 10 2006 012 733 | 9/2007 |
| DE | 10 2006 012 775 | 9/2007 |
| DE | 10 2006 036 052 | 2/2008 |
| DE | 10 2007 012 967 | 9/2008 |
| DE | 10 2007 040 017 | 2/2009 |
| DE | 10 2007 041 552 | 3/2009 |
| DE | 10 2007 053 688 | 5/2009 |
| DE | 10 2008 005 277 | 7/2009 |
| DE | 10 2009 022 869 | 12/2010 |
| DE | 10 2009 035 233 | 3/2011 |
| DE | 10 2009 050 779 | 4/2011 |
| EP | 0 069 531 | 1/1983 |

(56) References Cited

FOREIGN PATENT DOCUMENTS

| | | |
|---|---|---|
| EP | 0 245 791 | 11/1987 |
| EP | 0 388 244 | 9/1990 |
| EP | 0 799 976 | 10/1997 |
| EP | 0 799 977 | 10/1997 |
| EP | 0 821 138 | 1/1998 |
| EP | 0 834 655 | 4/1998 |
| EP | 0 859 130 | 8/1998 |
| EP | 0 896 129 | 2/1999 |
| EP | 0 924 393 | 6/1999 |
| EP | 1 008 729 | 6/2000 |
| EP | 1 197 641 | 4/2002 |
| EP | 1 291 563 | 3/2003 |
| EP | 1 347 154 | 9/2003 |
| EP | 1 447 602 | 8/2004 |
| EP | 1 475 518 | 11/2004 |
| EP | 1 477 636 | 11/2004 |
| EP | 1 703 184 | 9/2006 |
| EP | 1 476 642 | 1/2008 |
| EP | 2 093 388 | 8/2009 |
| FR | 525 481 | 9/1921 |
| FR | 966 121 | 12/1951 |
| FR | 996 121 | 12/1951 |
| GB | 1 212 327 | 11/1970 |
| GB | 2 161 583 | 1/1986 |
| JP | 57-13094 | 1/1957 |
| JP | 55-72965 | 6/1980 |
| JP | 57-13094 | 1/1982 |
| WO | 99/67537 | 12/1999 |
| WO | 03/078804 | 9/2003 |
| WO | 2004/088094 | 10/2004 |
| WO | 2004/088099 | 10/2004 |
| WO | 2007068586 | 6/2007 |
| WO | 2008009983 | 1/2008 |
| WO | 2008/140897 | 11/2008 |
| WO | 2009071457 | 6/2009 |
| WO | 2010/040617 | 4/2010 |

OTHER PUBLICATIONS

Pohl, Dirk, et al., "Vanecam® FastPhaser-Camphasing System for Improvement of Phasing Rate and Reduction of Oil Consumption", Konfernz Haus der Technik Variable Ventilsteuerung, 17 pages, Feb. 2007.

* cited by examiner

OSCILLATING-MOTOR CAMSHAFT ADJUSTER HAVING A HYDRAULIC VALVE

This application claims the benefit of German patent application number DE 10 2010 014 500.9 filed on Apr. 10, 2010 and German patent application number DE 10 2010 045 358.7 filed on Sep. 14, 2010, each of which is incorporated herein by reference in their entirety and for all purposes.

BACKGROUND OF THE INVENTION

The invention relates to an oscillating-motor camshaft adjuster having a hydraulic valve that has two working ports.

DE 10 2006 012 733 B4 and DE 10 2006 012 775 B4 relate to an oscillating-motor camshaft adjuster having a hydraulic valve that has two working ports. These two working ports each have a standard opening axially adjacent to one another and an opening for the utilization of pressure peaks as a consequence of camshaft alternating torques. In this case, in order to adjust the camshaft, a hydraulic pressure can be introduced from a supply port to the working port that is to be loaded, whereas the working port that is to be relieved of pressure is guided to a tank port. The hydraulic valve is designed as a 4/3-way valve in cartridge construction. Non-return valves, which are designed as band-shape rings, are inserted on the inside in the bush. By means of these non-return valves, camshaft alternating torques are utilized in order to be able to adjust the camshaft adjuster particularly rapidly and with a relatively low oil pressure. For this purpose, non-return valves cover the openings for utilizing pressure peaks as a consequence of camshaft alternating torques.

SUMMARY OF THE INVENTION

The object of the present invention is to create an oscillating-motor camshaft adjuster that is controlled in a simple manner and with little expenditure for fine tuning.

This problem is solved according to the embodiments of the invention set forth herein. In one example embodiment of the present invention, an oscillating-motor camshaft adjuster is provided which comprises a hydraulic valve. The hydraulic valve comprises two working ports, each of the working ports having a standard opening arranged axially adjacent to one another and an additional opening for utilizing pressure peaks as a consequence of camshaft alternating torques, a supply port, and a tank port. A hydraulic pressure can be guided from the supply port to one of the two working ports to be loaded, while the other of the two working ports to be relieved of pressure is guided to the tank port. At least one first position of the hydraulic valve can be controlled proportionally. In the at least one first position, pressure peaks of the working port to be relieved of pressure are blocked relative to the working port to be loaded.

Further, proceeding from a blocking center position of the hydraulic valve, initially one of the at least one first position and at least one further position can be controlled in order to utilize the camshaft alternating torques.

The hydraulic valve may further comprise a piston, which is guided inside a bush, and two outer webs for blocking the two standard openings. Two ribs may be provided axially between the outer webs, with which, on the one hand, the supply port can be blocked in the blocking center position against both working ports and on the other hand, one of the additional openings for the utilization of the pressure peaks as a consequence of camshaft alternating torques can be blocked in the at least one first position against the supply port, from which the hydraulic pressure is guided to the standard opening past the additional opening blocked by a non-return valve.

The standard opening of the working port to be relieved of pressure may be blocked in the at least one first position by means of one of the outer webs against the additional opening of the same working port. The outer web may have a cross bore, which guides hydraulic fluid to the tank port from the standard opening of the working port to be relieved of pressure in the at least one first position via the piston which is designed to be hollow.

In the proportionally controllable at least one first position, the pressure peaks of the working port to be relieved of pressure are blocked relative to the working port that is to be loaded and the supply port.

According to one advantage provided by an example embodiment of the invention, the camshaft alternating torques can be utilized for rapidly adjusting the phase of the camshaft with the oscillating-motor camshaft adjuster according to the invention. In addition, as a consequence of utilizing the camshaft alternating torques in an advantageous manner, it is possible to make an adjustment with a relatively low oil pressure. A small dimensioning of the oil pump made possible in this way improves the efficiency of the internal combustion engine. The flow of hydraulic fluid that is saved is available for other uses, such as, for example, adjusting the hydraulic valve stroke.

In the most recent past, oscillating-motor camshaft adjusters have found use also in internal combustion engines with few cylinders for purposes of reducing fuel consumption, increasing performance and decreasing emissions. The fewer the number of cylinders there are, the greater the fluctuations there are in the camshaft alternating torques. A great need for fine-tuning the control of the hydraulic valve, however, goes hand in hand with the utilization of the very highly fluctuating camshaft alternating torques for phase adjustment. According to another advantage provided by an example embodiment of the invention, the hydraulic valve can be controlled proportionally in a first position, in which the effect of non-return valves for the utilization of camshaft alternating torques is circumvented. The control process, alternating between utilization of the camshaft alternating torques and circumvention of this utilization can be continually controlled as a consequence of the proportional controllability. Thus, to favor a higher control performance, the hydraulic valve can be additionally controlled in a further position for circumventing the utilization of the camshaft alternating torques.

A structurally particularly simple implementation of a hydraulic valve is achieved in accordance with example embodiments of the present invention. In contrast to the hydraulic valve shown in DE 10 2006 012 733 B4 and DE 10 2006 012 775 B4, a relatively small additional cost arises for providing the two additional ribs on the piston in accordance with the present invention. This additional cost is negligible, for example, in the case of a plastic piston or another injection-molded piston. The distance between the ribs relative to the corresponding annular webs or inner annular grooves inside the bush must thus be precisely defined, since an overlapping of these ribs with the annular webs of the bush determines the flow cross sections.

In a particularly advantageous manner, it is thus possible to manufacture such a hydraulic valve according to the invention in many identical parts, which originate from hydraulic valves, without circumventing the utilization of the camshaft alternating torques or, in fact, completely without utilizing the camshaft alternating torques. Likewise, there exists a high potential for producing identical parts with hydraulic valves having mid-locking. Such an identical parts strategy when the piston is changed is shown, for example, in DE 10 2009 022 869.1-13, which has not been pre-published.

Additional advantages of the invention may be derived from the description and the drawings.

BRIEF DESCRIPTION OF THE DRAWINGS

The present invention will hereinafter be described in conjunction with the appended drawing figures, wherein like reference numerals denote like elements.

DETAILED DESCRIPTION

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

Figure 1:
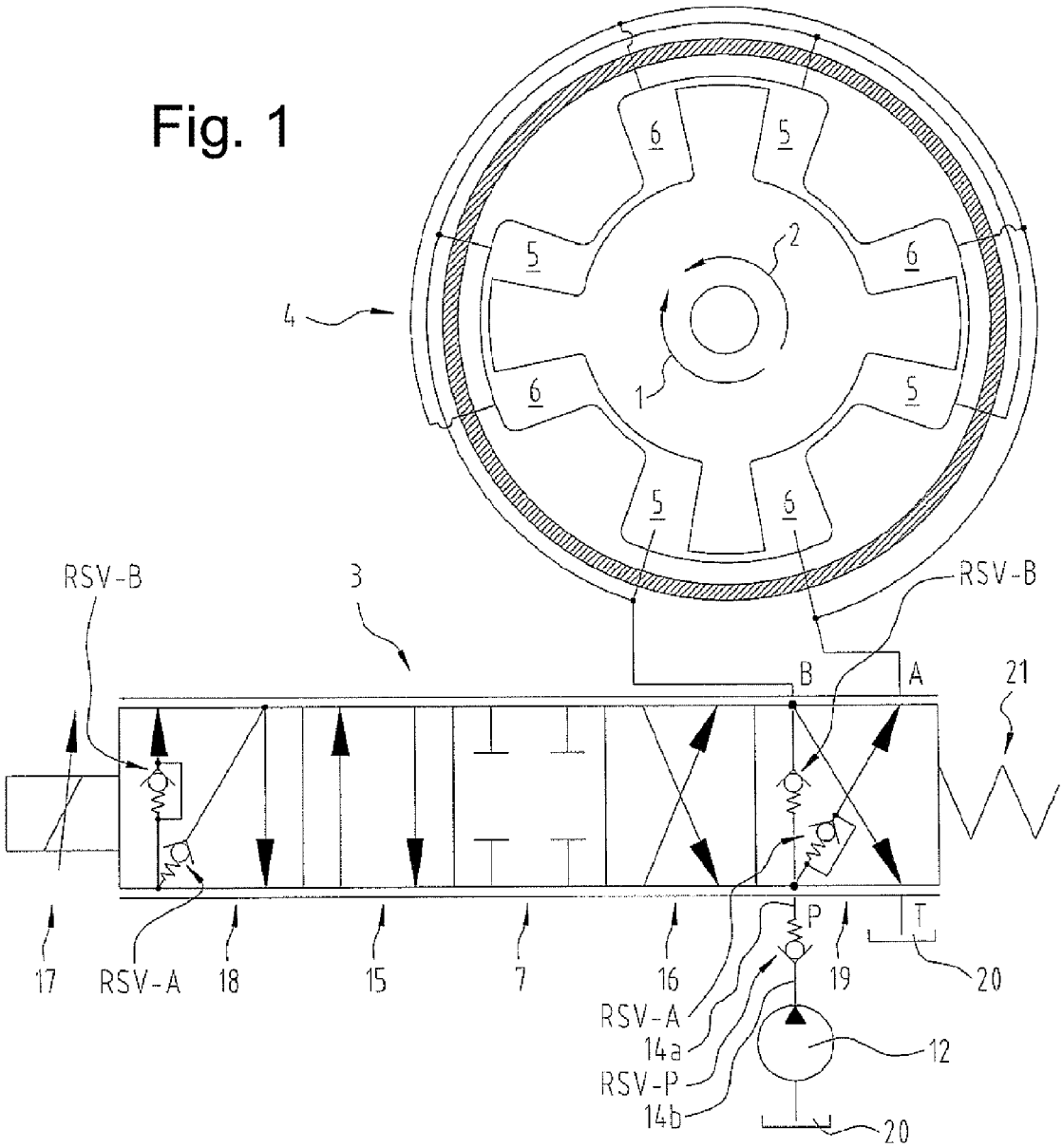
FIG. 1 shows an example embodiment of a circuit diagram of a proportionally controllable hydraulic valve that can be actuated in five main positions.

FIG. 1, in a circuit diagram, shows a hydraulic valve 3 in accordance with an example embodiment of the present invention, which can be actuated by means of an electromagnet 17 against a spring force of a spring 21 and which is controlled proportionally. An oscillating-motor camshaft adjuster 4 can be pivoted by this hydraulic valve 3. The angular position between the crankshaft and the camshaft can be changed with such an oscillating-motor camshaft adjuster 4 during the operation of an internal combustion engine. By rotating the camshaft, the opening and closing time points of the gas exchange valves are shifted so that the internal combustion engine offers its optimal performance at the speed involved. The oscillating-motor camshaft adjuster 4 thus makes possible a continual adjustment of the camshaft relative to the crankshaft.

A first working port A and a second working port B exit from hydraulic valve 3 to oscillating motor camshaft adjuster 4. Hydraulic valve 3 has four ports and five positions and can thus be designated also as a 4/5-way valve with a blocking center position 7. In order to now pivot the oscillating-motor camshaft adjuster 4 into the first direction of rotation 1, hydraulic valve 3 is found in one of the two positions 16, 19, which are shown by the two boxes behind the blocking center position 7. In FIG. 1 of the drawings, the hydraulic valve is found way in back in position 19 of the box. In this way, pressure chambers 6 assigned to this direction of rotation 1 are loaded from the first working port A with a pressure that comes from a supply port P. In contrast, pressure chambers 5 assigned to the second, i.e., opposite, direction of rotation 2 to the second working port B are relieved of pressure. The second working port B is guided to a tank 20 via a tank port T for this purpose.

The reverse applies analogously. That is, in order to now pivot the oscillating-motor camshaft adjuster 4 into the second direction of rotation 2, hydraulic valve 3 is found in one of the two positions 18, 15, which are shown by the two boxes in front of the blocking center position 7. Pressure chambers 5 assigned to this direction of rotation 2 in these positions 18, 15 are loaded from the second working port B with a pressure that comes from the supply port P. In contrast, pressure chambers 6 assigned to the first, i.e., opposite, direction of rotation 1 to the first working port A are relieved of pressure. The first working port A is guided to tank 20 via the tank port T for this purpose.

All four ports A, B, P, T are blocked in said blocking center position 7. The adjustment of the camshaft is produced without utilizing the camshaft alternating torques in the two positions 15, 16 adjacent to this blocking center position 7.

For this purpose, in position 15, supply port P is guided to the second working port B, whereas the first working port A is guided to tank port T. A bypass via a non-return valve is not provided in this position 15.

In position 16, supply port P is guided to the first working port A, whereas the second working port B is guided to tank port T. A bypass via a non-return valve is also not provided in this position 16.

In the two outermost positions 18, 19 of hydraulic valve 3, the adjustment of the camshaft is made by utilizing the camshaft alternating torques. For this purpose, the one outermost position 18 is designed similar to the directly adjacent position 15. Also, however, a flow volume of hydraulic fluid coming from a non-return valve RSV-A assigned to the first working port A is made available to supply port P. In contrast, the other outermost position 19 is designed similar to the directly adjacent position 16. Also, however, a flow volume of hydraulic fluid coming from a non-return valve RSV-B assigned to the second working port B is made available to supply port P.

This additional flow volume from working port A or B to be relieved of pressure is fed into the flow volume coming from an oil pump 12 at supply port P. The supply port P thus leads via a pump non-return valve RSV-P to oil pump 12, which introduces the pressure for adjusting the oscillating-motor camshaft adjuster 4. This pump non-return valve RSV-P in this case blocks the pressures in hydraulic valve 3, so that peak pressures coming from the working port A or B to be relieved of pressure can be made available to a greater fraction of the adjustment support than would be the case in an open oil pump line 14*a*, 14*b*.

FIG. 2 to FIG. 6 show example structural embodiments of hydraulic valve 3 in the five positions 18, 15, 7, 16, 19 according to FIG. 1.

Figure 2:
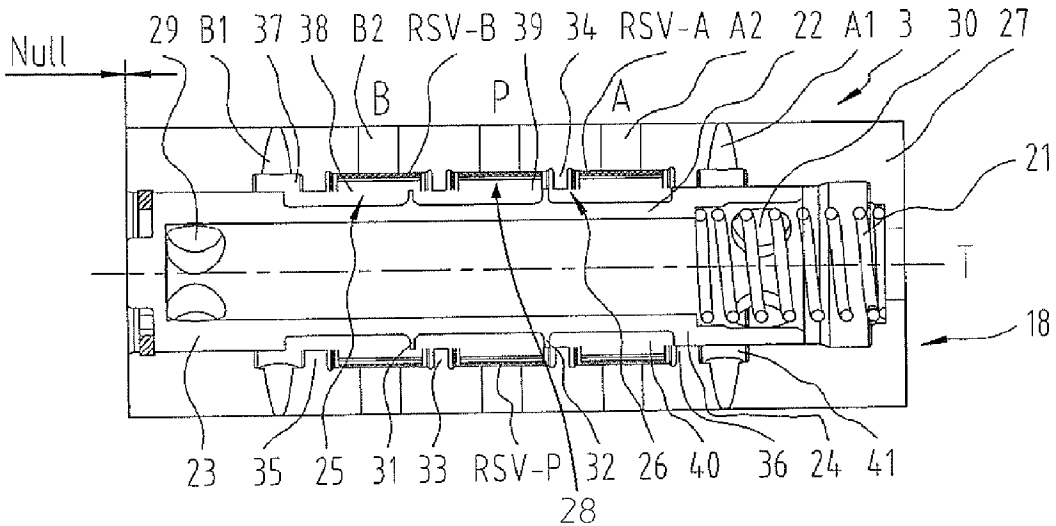
FIG. 2 shows an example structural implementation of the hydraulic valve according to FIG. 1 in one position.

FIG. 2 shows the hydraulic valve 3 in the first position 18, in which electromagnet 17 according to FIG. 1 does not move a hollow piston 22 of hydraulic valve 3. The stroke of piston 22 thus lies at zero. Piston 22 can move inside a bush 27 against the force of spring 21 designed as a screw-type pressure spring. The end on the front side facing electromagnet 17 is thus closed for producing a bearing surface for an actuating tappet of electromagnet 17, whereas the other end on the front side is open for producing the tank port T. Piston 22 has outer webs 23, 24, on its two ends, which are guided relative to bush 27. The two outer webs 23, 24 are pierced by means of cross bores 29, 30, so that an access to tank port T is present from these cross bores 29, 30 via the inside space of hollow piston 22.

Two narrow ribs 31, 32 that run around piston 22 are provided axially between the two outer webs 23, 24. These circumferential ribs 31, 32 correspond to two annular webs 33, 34 extending from bush 27 radially to the inside. Two axial outer annular webs 35, 36 are also provided in addition to these two annular webs 33, 34. These four annular webs 33 to 36 are formed, since five inner annular grooves 37 to 41 are hollowed out of the bush. Five port bores which are drilled through the wall of bush 27 open into these five inner annular grooves 37 to 41.

These five port bores, axially on top of one another from the side of electromagnet 17, form the following:

- a standard opening B1 belonging to the second working port B,
- an opening B2 belonging to the second working port B for utilizing the camshaft alternating torques,
- the supply port P,
- a standard opening A1 belonging to the first working port A, and
- an opening A2 belonging to the first working port A for utilizing camshaft alternating torques.

Thus, in each case, two openings A1, A2 or B1, B2 are provided on the two working ports A, B. The axial inner openings A2, B2 for utilizing camshaft alternating torques are provided by these. In contrast to the axially outer openings A1, B1 that can be blocked from inside exclusively by outer webs 23, 24, the axially inner openings A2, B2 have band-shaped non-return valves RSV-A, RSB-B. Each of the band-shaped non-return valves RSV-A or RSB-B is inserted in an inner annular groove 25 or 26 radially inside the axially inner openings A2 or B2 of bush 27. According to the method described in DE 10 2006 012 733 B4, with non-return valves RSV-A, RSV-B, it is possible to provide a hydraulic pressure in the region of the supply port P, this pressure increasing in a short time to above the level of the hydraulic pressure in the hydraulic chambers 6 or 5 to be pressure-loaded, as a consequence of camshaft alternating torques. Then, from this supply port P, these hydraulic pressure peaks or this additional hydraulic fluid flow, together with the hydraulic pressure introduced to supply port P by oil pump 12, is made available to hydraulic chambers 6 or 5 to be loaded.

In addition, the band-shaped pump non-return valve RSV-P is provided in an inner annular groove 28. This pump non-return valve RSV-P is basically constructed in the same way as the two non-return valves RSV-A, RSV-B. However, this pump non-return valve RSV-P may have another response force.

In position 18 according to FIG. 2, the two center ribs 31, 32 are axially distanced from the two annular webs 33, 34, so that hydraulic fluid can penetrate through the gap between them. Likewise, hydraulic fluid can penetrate through the gap between the frontmost outer web 23 and the corresponding annular web 35 on bush 27. In contrast, the other outer web 24 blocks the rearmost inner annular groove 41 or the standard opening A1 belonging to the first working port A. For this purpose, the outer web 24 and the rearmost annular web 36 overlap over a large sealing length.

Because of this, in this position 18, hydraulic fluid from the supply port P can reach the standard opening B1 belonging to the second working port B via the pump non-return valve RSV-P. The other two non-return valves RSV-A and RSV-B thus block the openings A2 and B2 against pressures from the supply port P and from the standard opening B1 belonging to the second working port B. In contrast, short-term peak pressures are transmitted from the opening A2 belonging to the first working port A by its non-return valve RSV-A as a consequence of the camshaft alternating torques.

The first working port A is guided to tank port T or relieved of pressure via its standard opening A1 and cross bore 30.

Figure 3:
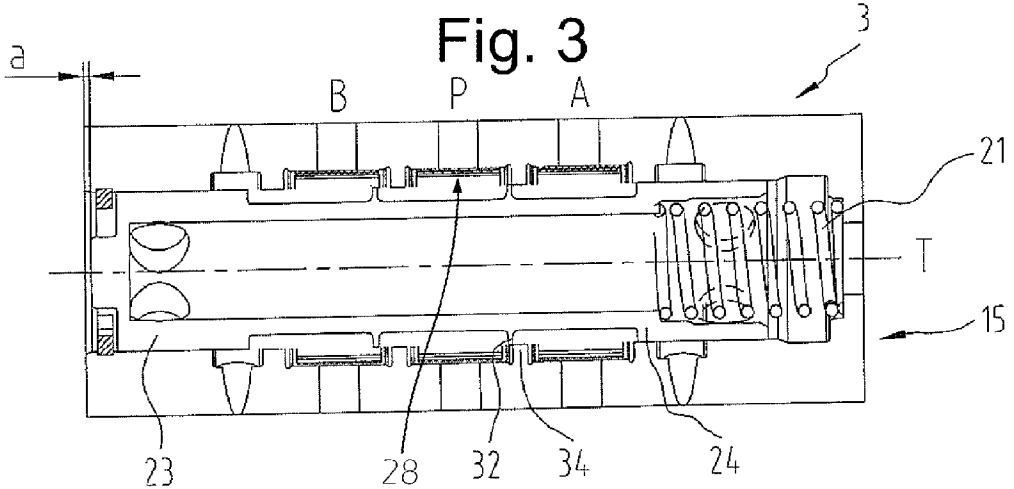
FIG. 3 shows the hydraulic valve according to FIG. 2 in another position.

FIG. 3 shows piston 22 with a stroke of a=0.4 mm. In this case, hydraulic valve 3 is found in position 15. In contrast to position 18, rear rib 32 covers the corresponding annular web 34 to such an extent that a flow through the very narrow gap is possible only with increased flow resistance. Also, since the very slightly pre-stressed non-return valve RSV-A has a flow resistance, it is not possible to reach short-term peak pressures as a consequence of camshaft alternating torques, from the first working port A to the second working port B.

The first working port A is guided to tank port T or relieved of pressure via its standard opening A1 and cross bore 30.

Figure 4:
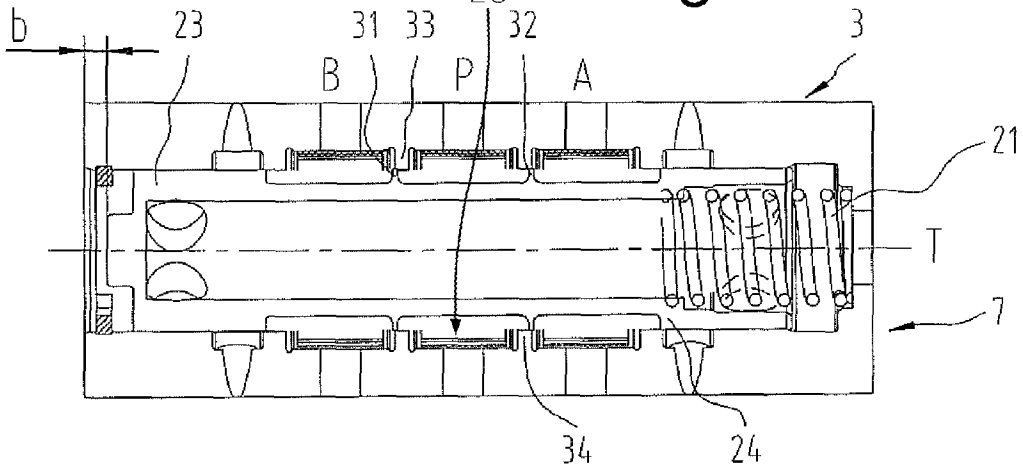
FIG. 4 shows the hydraulic valve according to FIG. 2 in another position.

FIG. 4 shows piston 22 with a stroke of b=1.55 mm. Here, hydraulic valve 3 is found in the blocking center position 7. The supply port P is closed by the two ribs 31, 32. For this purpose, ribs 31, 32 cover the corresponding annular webs 33, 34 to a correspondingly large extent. The two working ports A, B are blocked to tank outlet T. For this purpose, both cross bores 29, 30 are found in blocking center position 7 axially outside the axially outer inner annular grooves 37, 41.

Figure 5:
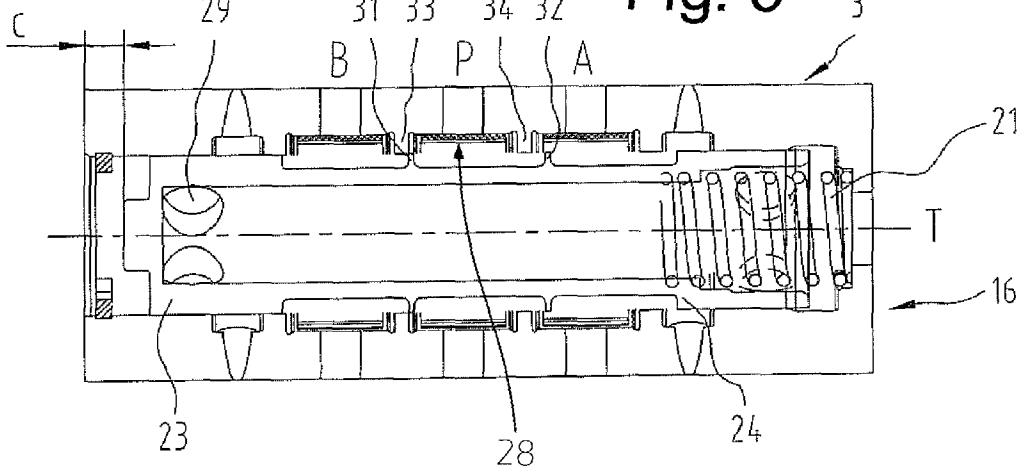
FIG. 5 shows the hydraulic valve according to FIG. 2 in another position.

FIG. 5 shows piston 22 with a stroke of c=2.7 mm. In this case, hydraulic valve 3 is found in position 16. In this case, hydraulic fluid coming from supply port P passes through the gap between rear rib 32 and the corresponding annular web 34 to the standard opening A1 of the first working port A. In contrast, front rib 31 covers the corresponding annular web 33 to such an extent that a flow through the very narrow gap is possible only with increased flow resistance. Also, since the very slightly pre-stressed non-return valve RSV-B has a flow resistance, it is not possible to reach short-term peak pressures as a consequence of camshaft alternating torques, from the second working port B to the first working port A.

The second working port B is guided to tank port T or relieved of pressure via its standard opening B1 and cross bore 29.

Figure 6:
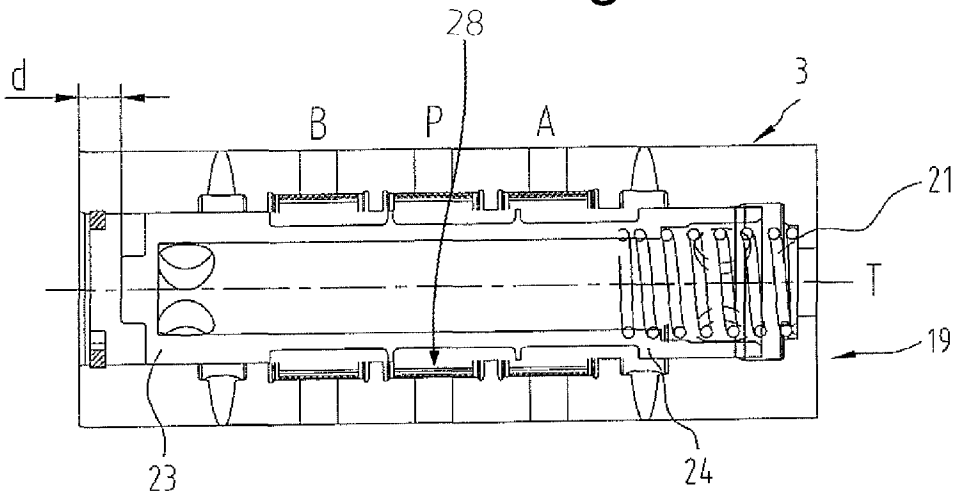
FIG. 6 shows the hydraulic valve according to FIG. 2 in another position.

FIG. 6 shows piston 22 with a stroke of d=3.1 mm. In this case, hydraulic valve 3 is found in position 19. In this position 19, the two center ribs 31, 32 are axially distanced from the two annular webs 33, 34, so that hydraulic fluid can penetrate through the gaps. Likewise, hydraulic fluid can penetrate through the gap between the rearmost outer web 24 and the corresponding annular web 36. In contrast, the other outer web 23 blocks the frontmost inner annular groove 37 or the standard opening B1 of the second working port B. For this purpose, the outer web 23 and the frontmost annular web 35 overlap over a large sealing length. Because of this, in this position 19, hydraulic fluid from the supply port P can reach the standard opening A1 of the first working port A via the pump non-return valve RSV-P. In this case, the other two non-return valves RSV-A and RSV-B block the openings A2 and B2 against pressures from the supply port P and from the standard opening B1 of the second working port B. In contrast, short-term peak pressures as a consequence of the camshaft alternating torques are transmitted from the opening B2 of the second working port B by its non-return valve RSV-B.

The second working port B is guided to tank port T or relieved of pressure via its standard opening B1 and cross bore 29.

In the example of embodiment presented, the standard opening A1 or B1 and the opening A2 or B2 are combined in order to utilize camshaft alternating torques first outside bush 27 to working port A or B, respectively. In an alternative embodiment, it is also possible to combine standard opening A1 or B1 and opening A2 or B2 also inside bush 27 in order to utilize the camshaft alternating torques. For this purpose, for example, an annular groove can be incorporated radially outside in the bush.

In another alternative embodiment, ball-type non-return valves can be used instead of band-shaped non-return valves. Thus, it is also possible, for example, to use ball-type non-return valves inside the hydraulic valve, as is demonstrated, for example, in DE 10 2007 012 967 B4. Ball-type non-return valves, in this case, however, do not absolutely need to be built into the bush of a cartridge valve. For example, it is also possible to use ball-type non-return valves in a rotor and to design the piston as a central valve, which is disposed so that it can move coaxially and centrally inside the rotor hub.

Depending on the application conditions of the valve in each case, filters may also be provided in the direction of flow in front of one or more or even all ports, these filters protecting the contact surfaces between the piston and the bush.

The hydraulic valve may also find application in a so-called central valve. In this case, the bush is not directly connected to the magnet part. Instead, the hydraulic valve is disposed centrally in the rotor of the oscillating-motor camshaft adjuster, so that the bush rotates together with the piston. The magnet, in contrast, is disposed in a torsionally rigid manner relative to the cylinder head, so that a relative movement occurs between the tappet of the magnet part and the piston.

The utilization of camshaft alternating torques need not be provided for both directions of rotation. It is also possible to dispense with one of the two axially outermost positions 18 or 19. Accordingly, the camshaft alternating torques can then be used directly for more rapid adjustment only for one direction of rotation.

In an alternative embodiment, a utilization of the camshaft alternating torques can be provided also for both directions of rotation, whereby in this case, however, one of the two positions 15, 16 circumventing non-return valves RSV-A, RSV-B will be omitted.

Further, any combination of positions is possible. Thus, it is possible to provide, in addition to the center position 7, the following positions:

18, 15, 16 or
15, 16, 19 or
18, 15, 19 or
18, 16, 19.

Another position may also be provided on the hydraulic valve, in which both working ports A, B are relieved of pressure relative to tank port T, so that a so-called mid-locking is made possible. In the case of such a mid-locking, a locking pin that fixes the rotor in an angular position relative to the stator, which is not an end position, is provided in the oscillating-motor camshaft adjuster. Such a mid-locking is presented, for example, in DE 10 2004 039 800 B4 and the unpublished DE 10 2009 022 869.1-13.

The described embodiments only involve exemplary embodiments. A combination of the described features for the different embodiments is also possible. Additional features for the device parts belonging to the invention, particularly those which have not been described, can be derived from the geometries of the device parts shown in the drawings.

LIST OF REFERENCE CHARACTERS

1 Direction of rotation
2 Direction of rotation
3 Hydraulic valve
4 Oscillating-motor camshaft adjuster
5 Pressure chamber
6 Pressure chamber
7 Blocking center position
8 Alternating torque return port
9 Alternating torque return port
10 Tank return
11 Return line
12 Oil pump
13 Return line
14 a, b Oil pump line
15 Position
16 Position
17 Electromagnet
18 Position
19 Position
20 Tank
21 Spring
22 Piston
23 Outer web
24 Outer web
25 Inner annular groove
26 Inner annular groove
27 Bush
28 Inner annular groove
29 Cross bores
30 Cross bores
31 Rib
32 Rib
33 Annular web
34 Annular web
35 Annular web
36 Annular web
37 Inner annular groove
38 Inner annular groove
39 Inner annular groove
40 Inner annular groove
41 Inner annular groove
A First working port
A1 First standard opening
A2 First opening for utilization of camshaft alternating torques
B Second working port
B1 Second standard opening
B2 Second opening for utilization of camshaft alternating torques
P Supply port
T Tank port

What is claimed is:

1. A hydraulic valve for an oscillating-motor camshaft adjuster, the hydraulic valve comprising:

two working ports, each of the working ports having a standard opening arranged axially adjacent to one another and an additional opening for utilizing pressure peaks as a consequence of camshaft alternating torques, a supply port, and a tank port, wherein:

a hydraulic pressure is guided from the supply port to one of the two working ports to be loaded, while the other of the two working ports to be relieved of pressure is guided to the tank port, at least one first position of the hydraulic valve for guiding the hydraulic pressure from the supply port to the working port to be loaded is controlled proportionally, in the at least one first position, pressure peaks of the working port to be relieved of pressure are blocked relative to the working port to be loaded.

2. The hydraulic valve according to claim 1, wherein proceeding from a blocking center position of the hydraulic valve, initially one of the at least one first position and at least one further position are controlled in order to utilize the camshaft alternating torques.

3. The hydraulic valve according to claim 2, further comprising:

a piston, which is guided inside a bush, and two outer webs for blocking the two standard openings, and two ribs, which are provided axially between the outer webs, with which, on the one hand, the supply port is blocked in the blocking center position against both working ports, and on the other hand, one of the additional openings for the utilization of the pressure peaks as a consequence of camshaft alternating torques is blocked in the at least one first position against the supply port, from which the hydraulic pressure is guided to the standard opening past the additional opening blocked by a non-return valve.

4. The hydraulic valve according to claim 3, wherein the standard opening of the working port to be relieved of pressure is blocked in the at least one first position by means of one of the outer webs against the additional opening of the same working port.

5. The hydraulic valve according to claim 4, wherein the outer web has a cross bore, which guides hydraulic fluid to the tank port from the standard opening of the working port to be relieved of pressure in the at least one first position via the piston which is hollow.

6. The hydraulic valve according to claim 1, wherein, in said proportionally controllable at least one first position, the pressure peaks of the working port to be relieved of pressure are blocked relative to the working port that is to be loaded and the supply port.

* * * * *